US009409075B2

(12) United States Patent
Turk

(10) Patent No.: US 9,409,075 B2
(45) Date of Patent: Aug. 9, 2016

(54) GOLF PRACTICE DEVICE

(71) Applicant: Ender Turk, Munich (DE)

(72) Inventor: Ender Turk, Munich (DE)

( * ) Notice: Subject to any disclaimer, the term of this patent is extended or adjusted under 35 U.S.C. 154(b) by 0 days.

(21) Appl. No.: 14/879,134

(22) Filed: Oct. 9, 2015

(65) Prior Publication Data

US 2016/0107061 A1 Apr. 21, 2016

(30) Foreign Application Priority Data

Oct. 17, 2014 (DE) ..... 10 2014 014 548
Dec. 9, 2014 (DE) ..... 10 2014 018 105

(51) Int. Cl.
*A63B 69/36* (2006.01)

(52) U.S. Cl.
CPC ..... *A63B 69/36* (2013.01); *A63B 2208/0204* (2013.01)

(58) Field of Classification Search
USPC ..... 473/219, 220, 226, 257, 258, 259, 260, 473/264–272
See application file for complete search history.

(56) References Cited

U.S. PATENT DOCUMENTS 3,339,927 A * 9/1967 Nunn ..... A63B 69/3644 248/455
4,383,687 A * 5/1983 Wolff ..... A63B 24/0003 359/872
5,433,619 A * 7/1995 Maejima ..... H01R 13/62933 439/157
6,863,619 B2 * 3/2005 Blacklock ..... A63B 69/3632 473/259
7,281,986 B2 * 10/2007 Tolson ..... A63B 69/3614 473/257
7,491,132 B2 * 2/2009 Bush, III ..... A63B 24/0003 473/257
7,556,570 B2 7/2009 Thurmer
8,591,349 B1 * 11/2013 Jones ..... A63B 69/3644 473/229
2014/0128174 A1 5/2014 Hardaway

FOREIGN PATENT DOCUMENTS

DE 103 29 920 A1 2/2005
DE 202009005761 U1 4/2010
DE 20 2013 006 560 U1 8/2014

* cited by examiner

*Primary Examiner* — Nini Legesse
(74) *Attorney, Agent, or Firm* — Volpe and Koenig, P.C.

(57) ABSTRACT

A golf practice device, for practicing the back swing of a golf swing, includes a folding device, which can be arranged so as to be inclined against the horizontal about a predetermined angle. The angle is the angle of inclination of the swing plane of the back swing. The device also includes a trigger device, which cooperates with the folding device. The trigger device is adapted to lock the folding device in the predetermined angle in a locked mode and to release the locking of the folding device in a trigger mode. The folding device can be folded downwards about a pivot axis in response to releasing the locking device.

10 Claims, 3 Drawing Sheets

(a)

(a)

(b)

GOLF PRACTICE DEVICE

FIELD OF THE INVENTION

The invention relates to a practice device for practicing a golf swing, in particular a back swing of a golf swing. A correct golf swing, in particular a correct back swing or a correct takeaway, respectively, can be trained or practiced, respectively, by means of the practice device according to the invention.

BACKGROUND OF THE INVENTION

Various golf practice apparatuses or golf practice devices, respectively, by means of which a golf swing can be learned or practiced, respectively, are known from the prior art.

For example, a golf practice apparatus, by means of which an interactive guiding of a golf club is made possible when practicing a golf swing, is known from DE 20 2013 006 560 U1. This golf practice apparatus has a guide arm, by means of which the golf club can be guided interactively. For this purpose, the golf club is fastened to the guide arm. However, this type of golf practice apparatuses have the disadvantage that, on the one hand, they can only be used in a stationary manner and that, on the other hand, the purchase thereof is expensive. A free golf swing is furthermore not possible, because the golf club is fastened to the guide arm. When learning the golf swing, the guide arm can even be a hindrance, because it is not possible to swing the golf club freely.

A golf practice apparatus, which has a simpler design and which can be transported, is known from DE 103 29 920 A1. The training apparatus for golf swings shown therein consists of at least one guide ring, which is arranged through a holder in a plane, which runs vertically inclined by means of a holder, wherein two guide rings are present, which are arranged almost in a plane and which are accommodated in a holder at least partially at a distance to one another, wherein the two guide rings are embodied so as to be almost elliptical. It is to be possible through this that the golf player can apply his golf club along both guide rings and can carry out the swing. Due to a friction contact between the golf club and the guide rings, the golf player can control at any time, whether the golf club is in contact with the guide rings. However, it is disadvantageous here that a free golf swing is also almost impossible here, without touching the guide rings so that even though the golf player can learn a virtually ideal golf swing, the golf swing is nonetheless hindered by the training apparatus.

It is a disadvantage in the case of both known golf practice apparatuses that a "real" drive cannot be made therewith. Only the golf swing or the correct swing plane can be practiced without driving the golf ball.

OBJECT OF THE INVENTION

It is thus the object of the instant invention to provide a practice device for learning or for practicing, respectively, a golf swing, in particular a back swing, or for improving the golf swing plane, respectively, in response to the takeaway or in response to a back swing, by means of which it is ensured that the back swing is performed in the ideal swing plane, without the practice device hindering the golf swing, in particular the downswing.

SUMMARY

This object is solved according to the invention by means of a golf practice device according to the independent claim.

Advantageous embodiments and further development of the invention follow from the dependent claims.

Accordingly, provision is made for a golf practice device, in particular for practicing the back swing of a golf swing or the takeaway, respectively, having

- a folding device, which can be arranged so as to be inclined against the horizontal about a predetermined angle, wherein the angle is preferably the angle of inclination of the swing plane of the back swing, and
- a trigger device, which cooperates with the folding device, wherein the trigger device is adapted
- to lock the folding device in the predetermined angle in a locked mode and
- to release the locking of the folding device in a trigger mode, wherein the folding device can be folded downwards about a pivot axis in response to releasing the locking.

By means of the trigger device, it is attained in an advantageous manner that the locking of the folding device can be released in response to the back swing of the golf swing, so that the folding device folds downwards prior to the downswing or during the downswing, respectively, of the golf swing and thus does not hinder the downswing or does not stand in the way in response to the downswing, respectively.

By suitably arranging the folding device, wherein the inclination of the folding device corresponds to the angle of inclination of the swing plane, it is ensured that the back swing of the golf swing is performed in the ideal swing plane. If the golf club is located too far away from the folding device during the golf swing, the locking of the folding device is not released. If the golf club is located behind the (imaginary) swing plane during the back swing, the back swing cannot be carried out completely, because the folding device prevents the complete back swing. In addition, a release of the locking is not possible.

It is thus ensured through this that the back swing and thus preferably also the subsequent downswing are performed in the swing plane, which is defined by means of the folding device.

It is advantageous, if the folding device comprises a flat surface, the imaginary extension of which forms the swing plane.

In an embodiment of the invention, the trigger device can comprise a pole, which can be arranged to as to be pivotable relative to the folding device and the free end section of which can be releasably fastened to a free end section of the folding device, so as to lock the folding device in a predetermined angle. By pivoting the pole, the locking is released, so that the folding device folds downwards independently. Advantageously, the release of the locking takes place in that the pole is pushed slightly upwards by means of the golf club, in particular by means of the shaft of the golf club, during the back swing.

In an embodiment of the invention, the folding device has a recess on the free end, with which the trigger device can be engaged.

The trigger device or the pole, respectively, can be capable of being releasably fastened to the folding device by means of a fastening device.

Advantageously, the golf practice device has a base frame, wherein the folding device is articulated to the base frame so as to be pivotable about the pivot axis and/or wherein the trigger device is articulated pivotably to the base frame.

In an advantageous embodiment of the golf practice device, the angle of the folding device can be capable of being adjusted.

In a further embodiment of the golf practice device according to the invention, the latter can have a pivotable aligning pole, which facilitates an alignment of the golf practice device relative to the golf player.

In an embodiment of the invention, the trigger device can have an electrically, magnetically or pneumatically actuatable fixing means and a sensor device, which operatively cooperates with the fixing means, wherein the fixing means is adapted to lock the folding device in the predetermined angle, the sensor device is adapted to detect a back swing of the golf swing or a takeaway, respectively, and the fixing means is adapted to release the locking in response to a back swing, which is detected by the sensor device.

In this embodiment of the invention, the pole can be foregone in an advantageous manner. It is advantageous hereby, if the sensor device detects the back swing or the takeaway, respectively, in a contact-free manner. The back swing as well as the downswing can be performed thereby, without the golf club touching the golf practice device. The golf club also does not need to touch the practice device in response to the back swing so as to release the locking of the folding device.

It is advantageous hereby, if the sensor device is arranged on the folding device, in particular on the front surface of the folding device.

It is furthermore advantageous, if provision is made for at least two sensor devices.

BRIEF DESCRIPTION OF THE DRAWINGS

Further details and features of the invention follow from the description below in connection with the drawing.

DETAILED DESCRIPTION OF THE PREFERRED EMBODIMENTS

The instant invention relates to a device for improving the golf swing plane in the first moment of the takeaway. The device enables the golf players to backswing in the correct plane, so as to avoid a steep or flat takeaway.

A significant advantage as compared to common practice devices is that the device according to the invention collapses in response to the correct takeaway of the club by means of a trigger and does not hinder the player in response to downswing.

The device according to the invention is placed laterally and parallel to the shaft of the club in the address position. Depending on the club selection, the inclination of the plane can be adapted arbitrarily. The device according to the invention is suitable for right-handers as well as for left-handers.

Figure 4:
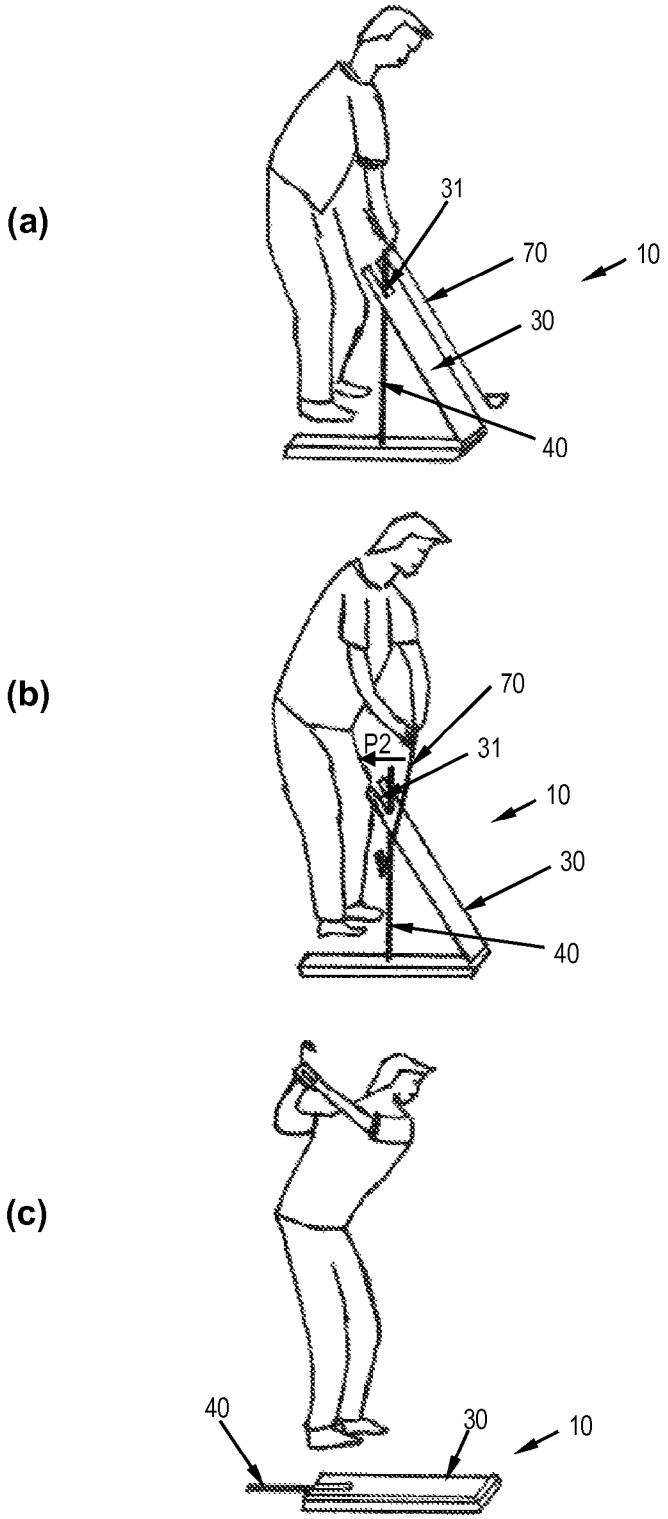
FIG. 4 shows the use of the golf practice device according to the invention.

FIG. 4 shows the use of a golf practice device 10 according to the invention.

Initially, the golf practice device 10 is arranged laterally next to the golf player. As is shown in illustration (a), the folding device 30 of the golf practice device is folded upwards, so that the plane of the folding device 30 runs substantially parallel to the shaft 70 of the golf club. The virtual plane, which is defined by the plane of the folding device 30, hereby defines the swing plane SE (see also FIG. 1(*a*)) in which the back swing is performed or in which the golf club is guided during the back swing or during the takeaway, respectively. During the back swing or during the takeaway, respectively, the shaft 70 of the golf club runs largely parallel to the swing plane SE. The folding device 30 is locked in a certain angle by means of a pole 40, wherein this angle corresponds to the angle of inclination of the swing plane SE.

In response to a back swing or in response to the takeaway, respectively, the shaft 70 of the golf club is guided in front of the folding device 30 and parallel to the folding device 30, wherein the shaft 70 should preferably be guided past the folding device 30 as closely as possible, as is shown in illustration (b) of FIG. 4.

In response to the back swing, the locking of the folding device 30 is released by means of the shaft 70, in that the shaft 70 is pressed against the pole 40. The pole 40 thereby releases from the folding device 30 and tilts backwards, so that the folding device 30 can tilt downwards, as is shown in illustration (c) of FIG. 4. The downswing, which follows the back swing, can now be performed without the golf practice device 10 hindering the downswing. It is not only possible to practice the golf swing through this. Even a "real" drive can be performed with a golf ball.

Figure 1:
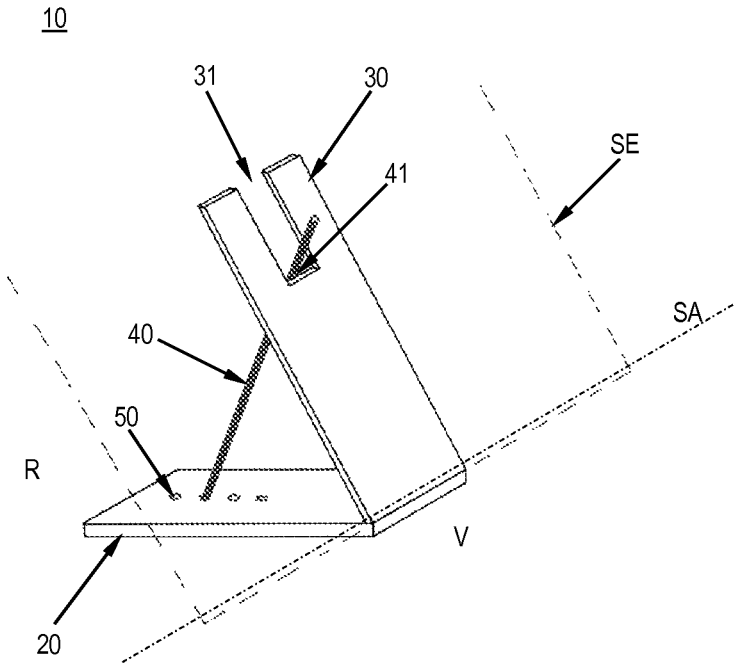
FIG. 1 shows a first embodiment of a golf practice device according to the invention in a perspective view and in a side view.
Figure 1:
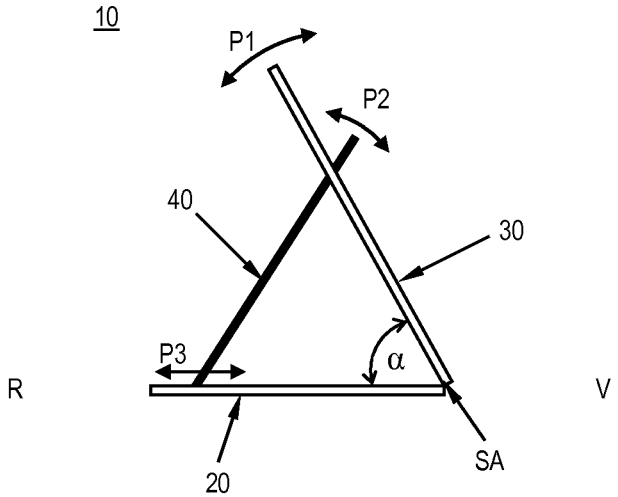

FIG. 1 shows a golf practice device 10 according to the invention in a perspective view and in a side view.

The golf practice device 10 has a base frame or a base plate 20, respectively, a folding device 30 and a trigger device 40.

The folding device 30, which is embodied as flat plate here, is articulated on the base frame 20, which is embodied as base plate here, about a pivot axis SA. For setting up the golf practice device, the folding device 30 is folded upwards about an angle $\alpha$, wherein the angle is chosen in such a manner that the angle of inclination of the folding device 30 corresponds to the angle of inclination of the (imaginary or desired, respectively) swing plane SE. The angle of inclination of the swing plane SE is thereby chosen in such a manner that the swing plane SE runs substantially parallel to the shaft 70 of the golf club (see FIG. 4(*a*)).

In response to the back swing, the golf club is guided in such a manner that the shaft 70 thereof swings in front of the folding device 30 substantially parallel and at a slight distance to the folding device 30. It is ensured therewith that the back swing is performed in the (ideal) swing plane SE, if the golf player has positioned himself correctly next to the golf practice device 10 and if the angle $\alpha$ is set correctly. In the alternative, the shaft 70 can also contact the front surface of the folding device 30 slightly in response to the takeaway, so that the locking is also released through this and the folding device 30 folds downwards.

The trigger device 40, which is formed as pole here, is furthermore arranged on the base plate 20. In the case of the embodiment shown in FIG. 1, the base plate has fastening means 50, which are embodied as blind holes. The lower end of the pole 40 can be introduced into one of the blind holes 50. The upper end of the pole is introduced into a recess 31, which is provided on the folding device 30, and is releasably fastened at that location by means of a fastening means 41, which is not shown here.

The fastening means 41 can be a magnet, a sleeve, a clamp, a plug or the like. It is only important that the folding device 30 is locked securely in the desired angle $\alpha$ by means of the fastening means 41 and that the trigger device or the pole 40, respectively, can be released easily from the folding device 30.

The length of the pole 40 is thereby chosen such that said pole protrudes on the front side of the folding device 30. In addition, the length of the pole 40 is chosen in such a manner that said pole protrudes on the front side of the folding device 30 by no more than a certain length, so that the golf player is forced to guide the golf club or the shaft 70 thereof, respectively, as closely as possible past the folding device 30 in response to the back swing, so as to touch the section of the pole, which protrudes in the front. When the golf club touches the pole 40 during the back swing (see FIG. 4(*b*)), the pole 40 is released from the fastening means 41 and is pushed upwards or pivot rearwards, respectively, by the golf club, so that the folding device 30 is no longer locked and can thus fold rearwards or downwards, respectively, independently (see FIG. 4(*c*)). This means that the folding device 30 folds downwards after the rear swing or prior to the downswing, respectively, so that the folding device 30 no longer stands in the way in response to the downswing. An unhindered downswing is made possible through this, wherein it is also ensured that said downswing is performed in the swing plane SE.

By providing a number of blind holes 50, the angle of the trigger device 40 can be adjusted. The length of the section of the pole, which protrudes on the front side of the folding device, can furthermore be adapted through this.

Instead of the blind holes 50 shown in FIG. 1, the pole 40 can also be arranged on the base plate 20 so as to be pivotable about a pivot axis. It is advantageous hereby, if the position of the pivot axis can be changed, that is, can be shifted forwards or rearwards, respectively.

Instead of the recess 31 shown in FIG. 1, provision can also be made for other fastening devices for fastening the trigger device 40 to the folding device 30. For example, provision can be made on the folding device 30 for a laterally protruding pin, on which the trigger device or the pole 40, respectively, can bear, so as to lock the folding device 30. It is only important that the folding device 30 and the trigger device 40 are embodied and are arranged relative to one another in such a manner that the trigger device 40 can be folded away with the help of the golf club in response to the back swing, so that the locking of the folding device 30 is released and the folding device 30 can fold downwards in an unhindered manner.

Figure 2:
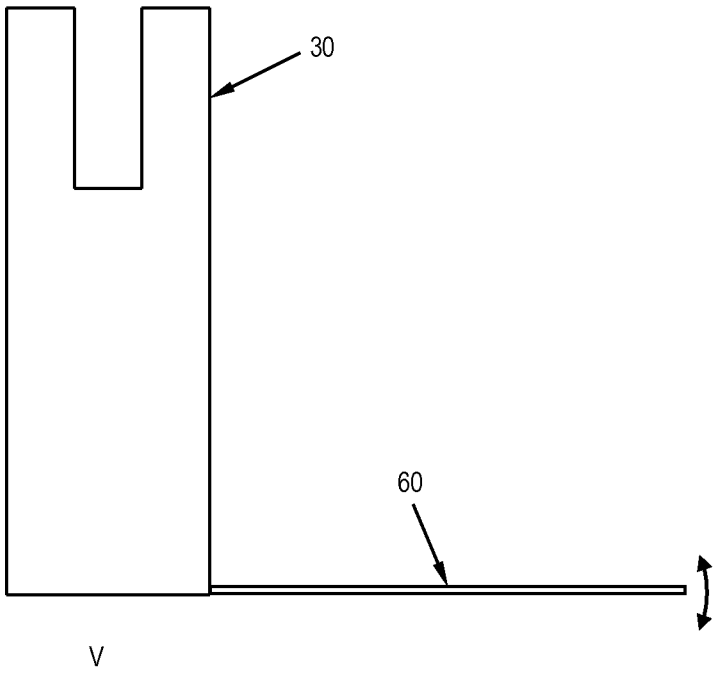
FIG. 2 shows a golf practice device according to the invention in a view from the front.

FIG. 2 shows a further development according to the invention of the golf practice device 10 shown in FIG. 1.

In addition, the golf practice device has an aligning pole 60 here, which is pivotably arranged on the base frame 20 or pivotably on the folding device 30, respectively. The aligning pole is hereby pivotably arranged in such a manner that it can be folded laterally downwards towards the bottom. The alignment of the golf practice device can be supported relative to the golf player with the help of the aligning pole 60. After aligning the golf practice device relative to the golf player, the aligning pole can be folded upwards again. In an embodiment of the invention, the aligning pole 50 can also be folded rearwards, so that it runs substantially parallel to the base frame 20 and does not hinder the golf player when performing a downswing.

Figure 3:
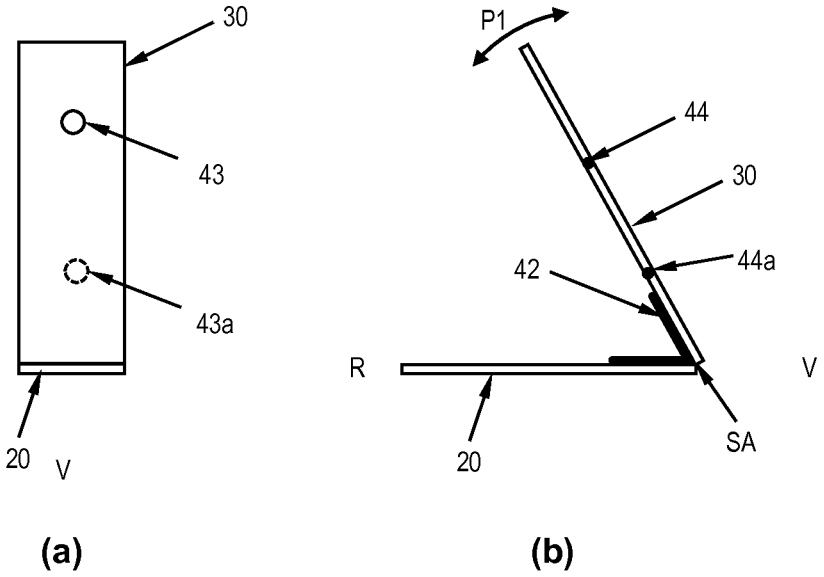
FIG. 3 shows an alternative embodiment of a golf practice device according to the invention in a view from the front and in a side view.

FIG. 3 shows a further embodiment of a golf practice device 10 according to the invention.

In the case of the golf practice device shown in FIG. 3, the trigger device has an electrically, magnetically or pneumatically actuatable fixing means 42 and a sensor device 43, which operatively cooperates with the fixing means, instead of a pole 40. The sensor device 43 is arranged on the front side of the folding device 30, preferably in an upper section of the folding device 30. The back swing is detected by means of the sensor device 43. The sensor device 43 is preferably adapted in such a manner that a rear swing is detected only if the golf club is guided past the folding device 30 below a certain maximum distance.

If such a back swing is detected, the electrically, magnetically or pneumatically actuatable fixing means 42 can release the locking of the folding device, so that the folding device 30 golfs downwards. For example, the fixing means 42 can pull a pin out of a pin accommodation after detecting a back swing, so that the folding device can fold downwards. Other electrically, magnetically or pneumatically actuatable fixing means are possible, wherein it only needs to be ensured that the fixing means can lock the folding device 30 in a desired angle $\alpha$ and can release the locking after detecting the back swing.

In an embodiment of the invention, provision can be made on the folding device 30 for a second sensor device 43*a*, which is arranged spaced apart from the first sensor device 43 below the first sensor device 43. Provision can hereby be made for a back swing to only be detected, if the golf club is guided past both sensor devices 43, 43*a* during the back swing within a predetermined minimum distance. For example, the detection of a rear swing can be omitted, if the golf club is only guided past one of the two sensor devices within the predetermined maximum distance during the back swing and is guided past the other sensor device at a distance, which is greater than the predetermined maximum distance. During the back swing, the golf player is thus forced to guide the golf club in such a manner that said golf club is actually guided in the "ideal" swing plane SE.

The embodiment of a golf practice device according to the invention shown with reference to FIG. 3 has the advantage that the folding device 30 is folded away in a contact-free manner in the case of a correctly executed back swing, that is, the golf club does not touch the golf practice device in response to the back swing. The back swing as well as the subsequent downswing are thus not hindered by the golf practice device.

In an advantageous embodiment of the invention, provision can be made for the electrically or pneumatically actuatable fixing means to be additionally embodied in such a manner that it pivots the folding device 30 upwards up to a predetermined angle $\alpha$. The angle $\alpha$ can be stored in a memory device of the fixing means. The angle $\alpha$ can also be the previously adjusted angle. The upwards pivoting of the folding device 30 can take place automatically after the downswing up to the predetermined angle $\alpha$—for instance after a downswing was detected (for which provision is also made on the golf practice device for a sensor device) or after a predetermined period of time after the folding device 30 was golfed downwards. For example, the folding device 30 can be pivoted upwards automatically again, fifteen seconds after the locking was released. In the alternative, the electrical and/or pneumatic upwards pivoting can also be triggered manually, for instance by actuating a switch or a button.

In a further embodiment of the invention, provision can be made on the folding device 30 for a sensor device 44, 44*a*, by means of which the angle of inclination of the shaft 70 of the golf club is detected. For this purpose, the sensor device can have two sensors 44 and 44*a*, which are arranged on top of one another on the folding device. The sensors 44 and 44*a* are adapted to detect the angle of inclination of the shaft in a contact-free manner. Together with the electrically or pneumatically actuatable fixing means, the folding device can be pivoted upwards (or downwards, if applicable) automatically, namely until the angle of inclination a of the folding device 30 corresponds substantially to the angle of inclination of the shaft 70. The golf player thus does not need to adjust the inclination of the folding device 30 by himself.

An advantage of the instant invention lies in that the latter can be produced in a simple manner with regard to the design thereof. A further advantage is that it cannot only be used in a stationary manner as a practice device, but can be used as mobile golf practice device. By collapsing it, the golf practice device can furthermore be stored in a space-saving manner and can be transported easily.

REFERENCE NUMERALS

10 golf practice device
20 base frame (e.g. base plate)
30 folding device (inclined, flat surface, e.g. plate)
31 recess on the free end of the folding device 30
40 trigger device
41 locking means for locking the trigger device 40 on the folding device 30
42 fixing means (preferably electrically actuatable)
43 sensor device
43*a* second sensor device
44, 44*a* sensor device for inclination detection
50 fastening means in/on the base frame 20
60 aligning pole
70 golf club or shaft of the golf club, respectively
α angle of inclination of the folding device 30
P1 pivot direction of the folding device 30
P2 pivot direction of the trigger device 40
P3 adjusting direction of the trigger device 40 in/on the base frame 20
R rear side
SA pivot axis of the folding device 30
SE (imaginary) swing plane
V front side

The invention claimed is:

1. A golf practice device (10), for practicing back swing of a golf swing, comprising:

a folding device (30), which can be arranged so as to be inclined relative to a horizontal base plate (20) about a predetermined angle (α), wherein the angle (α) is the angle of inclination of the swing plane of the back swing, and a trigger device (40), which cooperates with the folding device (30), wherein the trigger device (40) is configured to lock the folding device (30) in the predetermined angle (α) in a locked mode and to release the locking of the folding device (30) in a trigger mode in response to the backswing of the golf club, wherein the folding device (30) is folded downwards about a pivot axis (SA) in response to releasing the locking of the folding device (30).

2. The golf practice device according to claim 1, wherein the folding device (30) comprises a flat surface.

3. The golf practice device according to claim 1, wherein the trigger device (40) comprises a pole, which can be arranged to as to be pivotable relative to the folding device (30), and a free end section of which can be releasably fastened to a free end section of the folding device (30), so as to lock the folding device (30) in the predetermined angle (α).

4. The golf practice device according to claim 3, wherein the folding device (30) has a recess (31) on the free end, with which the trigger device (40) can be engaged.

5. The golf practice device according to claim 3, wherein the trigger device (40) can be releasably fastened to the folding device (30) by means of fastening means (41).

6. The golf practice device according to claim 1, further comprising a base frame (20), wherein the folding device (30) is articulated to the base frame (20) so as to be pivotable about the pivot axis (SA) and/or wherein the trigger device (40) is articulated pivotably to the base frame (20).

7. The golf practice device according to claim 1, wherein the angle (α) of the folding device (30) can be adjusted.

8. The golf practice device according to claim 1, further comprising a pivotable aligning pole (60).

9. A golf practice device (10), for practicing back swing of a golf swing, comprising:

a folding device (30), which can be arranged so as to be inclined relative to a horizontal base frame (20) about a predetermined angle (α), wherein the angle (α) is the angle of inclination of the swing plane of the back swing, and a trigger device (40), which cooperates with the folding device (30), wherein the trigger device (40) is configured to lock the folding device (30) in the predetermined angle (α) in a locked mode and to release the locking of the folding device (30) in a trigger mode, wherein the folding device (30) is folded downwards about a pivot axis (SA) in response to releasing the locking of the folding device (30), wherein the trigger device (40) comprises an electrically, magnetically or pneumatically actuatable fixing means (42) and a sensor device (43), which operatively cooperates with the fixing means, wherein the fixing means is adapted to lock the folding device (30) in the predetermined angle (α), the sensor device (43) is adapted to detect a back swing of the golf swing, and the fixing means is adapted to release the locking in response to a back swing, which is detected by the sensor device (43).

10. The golf practice device according to claim 9, wherein the sensor device (43) is arranged on the folding device (30) and/or wherein the trigger device (40) has at least a second sensor device (43*a*).

* * * * *